US005187940A

United States Patent [19]

Paxton

[11] Patent Number: 5,187,940

[45] Date of Patent: Feb. 23, 1993

[54] REFRIGERANT RECOVERY AND PURIFICATION SYSTEM

[75] Inventor: Russell Paxton, Azle, Tex.

[73] Assignee: Standard Motor Products, Inc., Grapevine, Tex.

[21] Appl. No.: 657,138

[22] Filed: Feb. 19, 1991

[51] Int. Cl.[5] ..... F25B 45/00

[52] U.S. Cl. ..... 62/77; 62/85; 62/292; 62/475

[58] Field of Search ..... 62/77, 85, 149, 292, 62/474, 475, 468, 470

[56] References Cited

U.S. PATENT DOCUMENTS

| | | | |
|---|---|---|---|
| 4,110,998 | 9/1978 | Owen | 62/125 |
| 4,261,178 | 4/1981 | Cain | 62/149 |
| 4,285,206 | 8/1981 | Koser | 62/126 |
| 4,304,102 | 12/1981 | Gray | 62/195 |
| 4,352,349 | 10/1982 | Yoho | 236/49.3 |
| 4,363,222 | 12/1982 | Cain | 62/292 |
| 4,364,236 | 12/1982 | Lower et al. | 62/77 |
| 4,441,330 | 4/1984 | Lower et al. | 62/149 |
| 4,476,688 | 10/1984 | Goddard | 62/149 |
| 4,480,446 | 11/1984 | Margulefsky et al. | 62/474 |
| 4,539,817 | 9/1985 | Staggs et al. | 62/149 |
| 4,768,347 | 9/1988 | Manz et al. | 62/149 |
| 4,805,416 | 2/1989 | Manz et al. | 62/292 |
| 4,809,520 | 3/1989 | Manz et al. | 62/292 |
| 4,903,499 | 2/1990 | Merritt | 62/149 |
| 4,938,031 | 7/1990 | Manz et al. | 62/145 |
| 4,939,903 | 7/1990 | Goddard | 62/77 |
| 4,939,905 | 7/1990 | Manz | 62/77 |
| 5,005,369 | 4/1991 | Manz | 62/149 |

OTHER PUBLICATIONS

Savas, Computer Control of Industrial processes May 21, 1966, p. 19.

*Primary Examiner*—John Sollecito

*Attorney, Agent, or Firm*—Hubbard, Thurman, Tucker & Harris

[57] ABSTRACT

A refrigerant recovery and purification system is provided. A one-pass system removes refrigerant, filters and purifies it and condenses and stores the refrigerant in its liquid state for reuse. A collection tank is provided which separates the non-condensible gases, thereby eliminating pressure buildup in the storage tank. The non-condensible gases are vented back to the system to selectively provide positive pressure for vacuum relief. The system also includes an oil separator for refrigerant which has passed through the compressor with a feedback line to return the oil to the compressor.

19 Claims, 3 Drawing Sheets

REFRIGERANT RECOVERY AND PURIFICATION SYSTEM

The present system is directed to apparatus and methods for recovering and purifying refrigerant from refrigeration systems such as automobile air conditioning systems. More particularly, the present invention is concerned with a one-pass system for removing refrigerant from a refrigeration system, purifying the refrigerant and storing it in its liquified state for re-use.

BACKGROUND OF THE INVENTION

In refrigeration systems, the refrigerant, such as freon, frequently becomes contaminated with moisture, particles and acid and must be replaced. Until recently, it has been common for the old refrigerant to simply be vented into the atmosphere prior to the refrigeration system being recharged. It is now known that such vented refrigerant is harmful to the environment, particularly causing serious contamination to the upper atmosphere and destruction of the ozone layer. Recent legislation has restricted and prohibited such venting activities and requires the used refrigerant to be removed in a closed system and stored for later purification or disposal.

Several systems have been developed for removing and purifying the refrigerant for later usage. U.S. Pat. No. 4,805,416 discloses a system for recovery, purification and recharging of refrigerant in a refrigeration system in which a compressor is connected through solenoid valves to a combined heat-exchange/oil separator unit which condenses the refrigerant and separates the oil therefrom. After the refrigeration system has been fully evacuated, the refrigerant recovery system cycles the refrigerant by the continuous operation of vaporizing, drying and condensing until substantially all of the moisture has been removed.

A similar system is shown in U.S. Pat. No. 4,441,330 wherein refrigerant is evacuated from a refrigeration system through a particulate filter, evaporator, compressor and condenser to a storage container. Again, after evacuation, a multiple-cycle purification/drying process is carried out. Thereafter, oil is added back into the refrigerant which is used to recharge the refrigeration system.

In the aforementioned patents and other prior art, the refrigerant recovery unit is essentially taken out of further service when the storage tank has been filled until a purification cycle is completed. This purification process may require from two to eight hours, depending upon the nature of the filtering system. Thus, when a storage tank is full, the recovery unit cannot provide further recovery services until the refrigerant in the tank is purified. Alternately, if the filled tank is replaced by a new storage tank, the refrigerant in the filled tank must be purified later using another unit.

Another difficulty with prior art systems is that certain non-condensible gases have often contaminated the refrigerant and must be removed. For example, air commonly leaks into a refrigeration system and is drawn off when the refrigerant is evacuated. Since most of the air cannot be condensed in the recovery unit, there is a build-up of non-condensible gases in the storage tank with the liquified refrigerant which must be periodically purged to avoid intolerable high pressure.

Yet another problem in prior art recovery systems is the difficulty of venting the systems after the refrigerant has been evacuated. During evacuation, the compressor pumps the refrigerant from the refrigeration system leaving a near vacuum in the recovery unit line after evacuation. It is necessary to vent the line in some manner in order to change filters. However, in doing so, refrigerant may be vented to the atmosphere resulting in the detrimental effects discussed earlier.

SUMMARY OF THE INVENTION

The present invention overcomes the problems of the prior art by providing a one-pass system which purifies the refrigerant in a single pass through the recovery system, following which the liquified refrigerant is stored for immediate re-use. The invention of the present system also removes the non-condensible gases before they reach the storage tank thereby eliminating the high pressure build-up in the storage tank. The present system also provides positive pressure means within the system to eliminate the vacuum after evacuation is finished so that the line may be serviced.

The present invention provides a system for recovering and purifying refrigerant from a refrigeration system including compression means for removing the refrigerant from the refrigeration system, oil separation means for removing the oil from the refrigerant, filter means for substantially removing the moisture from the refrigerant, condenser means for liquifying the refrigerant, collection means for removing non-condensible gases from the refrigerant and storage means for storing the liquified refrigerant. The collection means includes a device for removing and venting substantially all of the non-condensible gases from the refrigerant. The non-condensible gases are directed back into the system after evacuation so as to remove the vacuum in the system by a positive pressure feed. The filter means are designed to substantially remove all of the moisture from the system in a single pass through the system to eliminate the purification cycle required by the prior art.

The system of the present invention preferably also includes a particulate filter means for removing contaminants from the refrigerant, a first oil separator removing oil from the refrigerant before the compressor, a second oil separator which removes oil from the refrigerant after having passed through the compressor and a return line for feeding the separated oil back to the compressor. This system further includes a quick-change canister for each of the filters to facilitate replacement of the filters, and filter indicators to show pressure build-up in the canisters requiring filter changes.

The invention of the present system also includes a method of recovering and purifying the refrigerant in a refrigeration system, including pumping the refrigerant from a refrigeration system substantially in vapor form, removing particulate matter from the vaporized refrigerant, separating oil from the vaporized refrigerant, substantially removing the moisture from the vaporized refrigerant, substantially condensing the vaporized refrigerant, removing the non-condensible gas from the liquified refrigerant before storage and then storing the liquified refrigerant.

BRIEF DESCRIPTION OF THE DRAWINGS

The invention and its additional features and advantages are best understood from the following description, claims and drawings in which:

DETAILED DESCRIPTION OF PREFERRED EMBODIMENT

Figure 1:
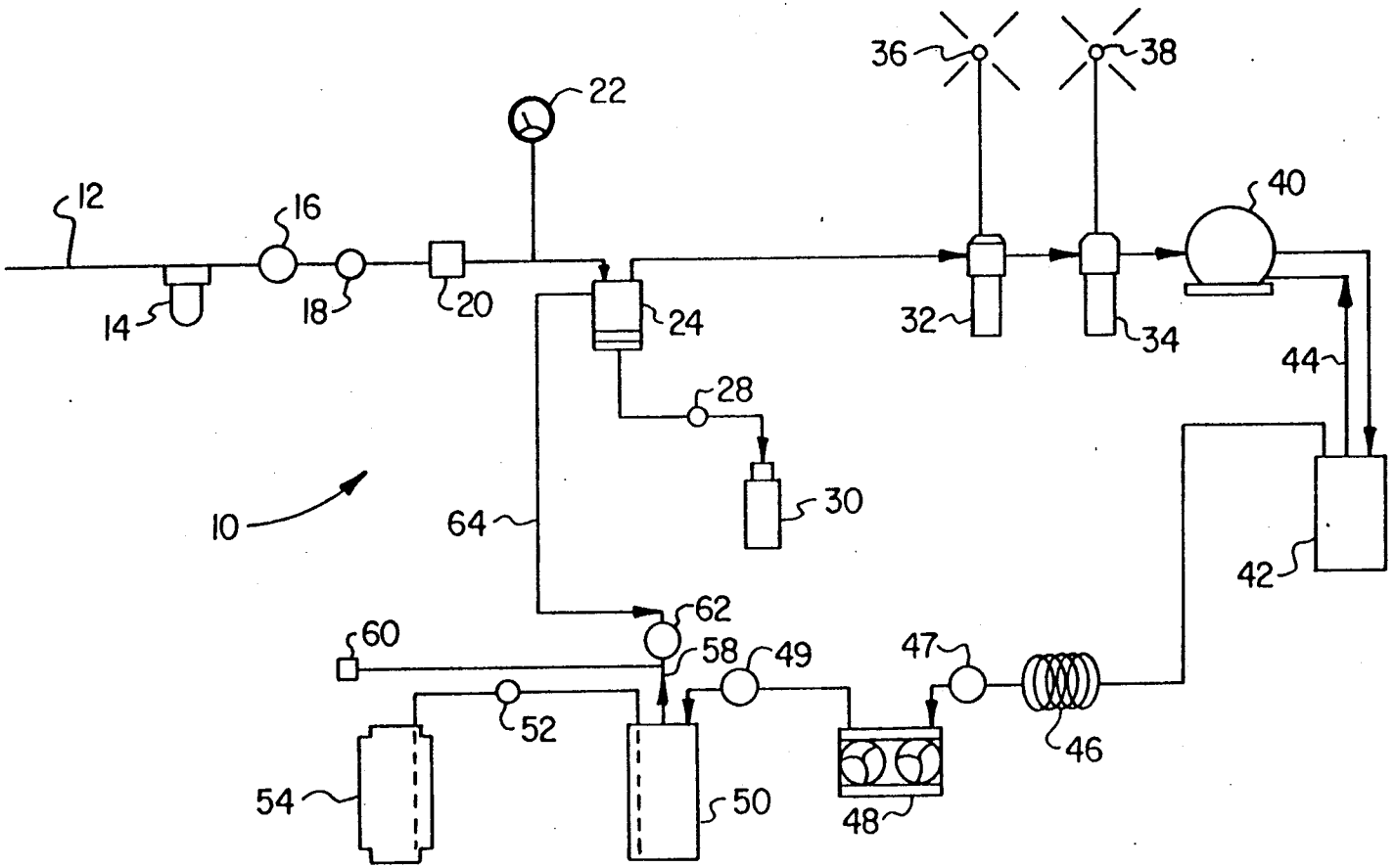
FIG. 1 is a schematic diagram of a refrigerant recovery and purification system in accordance with a preferred embodiment of the invention.

FIG. 1 illustrates a preferred embodiment of the refrigerant recovery and purification system 10 of the present invention. The system 10 includes an input line 12 connected to the refrigeration system containing refrigerant to be processed. Line 12 feeds to a particulate filter 14 which removes most of the particles from the refrigerant. Preferably particulate filter 14 has a 15 micron core and is mounted in a threaded bowl/lidcanister or other container enabling easy and quick change-out of the core.

A one-way check valve 16 stops refrigerant from escaping when the system is shut off. A conventional vacuum switch 18 is connected to check valve 16 and shuts off the system when the pressure in the system becomes essentially a vacuum compared to the refrigerant system. Next in line 12 is a recovery solenoid 20 which automatically opens up when the recovery system is started. Low pressure gauge 22 tells the operator how much pressure is in the recovery system as it operates.

Line 12 is then connected to an oil separator unit 24 for separating out the oil from the refrigerant. The conventional oil separator has a filter core trapping the oil which then drops to the bottom of the separator. A heat strap 26 is applied to the bottom of separator 24 to heat the oil. A hand tap 28 allows an operator to periodically drain oil separator 24 into an oil bottle 30.

Filter units 32 and 34 are arranged in tandem to process the refrigerant and remove most of the moisture therefrom. Preferably both filter cores are of a medium pressure, high absorbent type having sufficient filtering capacity to remove most of the moisture in a single pass through two filters. The filter cores are contained in a quick-change assembly comprising a threaded bowl and cap configuration. Preferably, the filter core and assembly are made by Parker Hannafin, Model No. 40-2. The filters preferably include visual indicators such as lights 36 and 38 which turn on when pressure builds up past a certain level indicating that the filters need to be changed, preferably at 25 psi.

A compressor 40 of a conventional type is connected to the filters and functions as a pump to draw refrigerant from the automobile refrigeration system. Downstream from compressor 40 is another conventional oil separator 42 which is used to separate out oil added to the refrigerant by compressor 40. A return line 44 returns the separated oil to compressor 40 to be reused.

The vapor refrigerant is then condensed for storage. Condensing begins by a cooling coil 46, preferably a copper tube coil, ¼" diameter about 4' in length. The refrigerant is condensed by a conventional condenser 48, which lowers the temperature to liquify the refrigerant. The liquid refrigerant then passes through another one-way check valve 49 to a collection tank 50 where the non-condensible gas is separated from the liquid refrigerant. A manual shut-off valve 52 connects the output line of collection tank 50 to a conventional storage tank 54. The exhaust line 58 of collection tank 50 is connected to a high pressure switch 60 and to an auto-purge solenoid 62 which in turn is connected to a positive pressure line 64 running back into oil separator 24.

Figure 2:
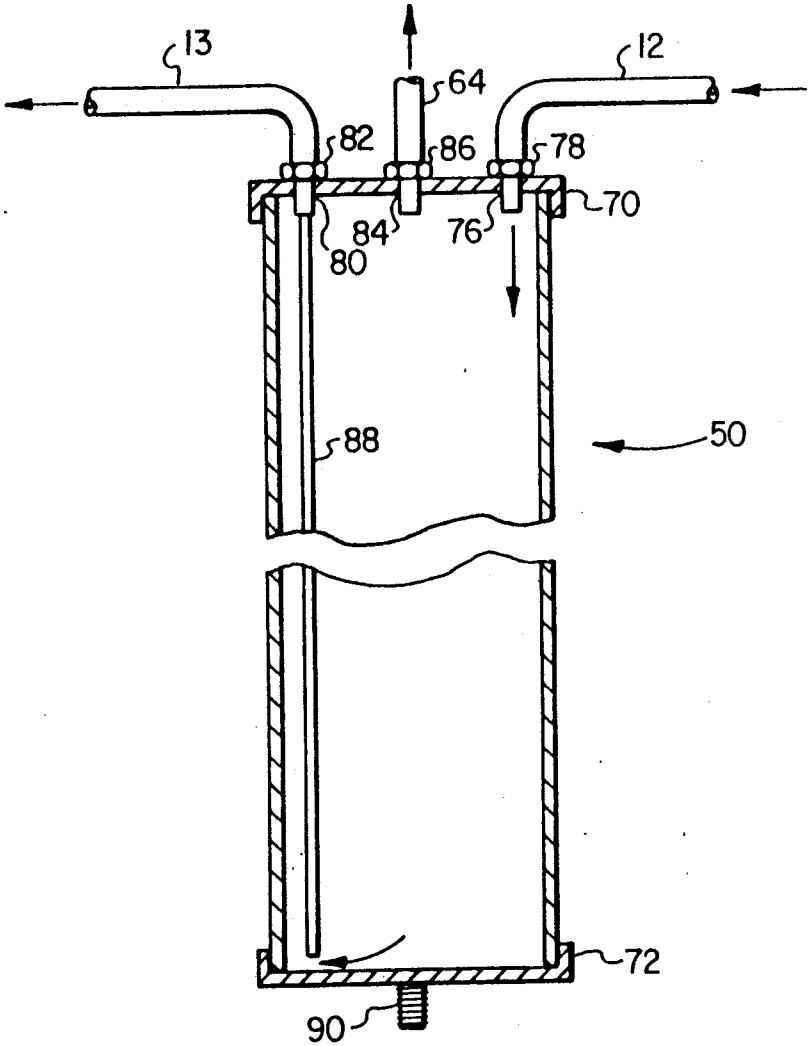
FIG. 2 is an elevational cross-section view of the collection tank of the embodiment of the invention shown in FIG. 1.

Looking now at FIG. 2, the collection tank 50 is shown in greater detail. Tank 50 is preferably includes a top cap 70 and bottom cap 72 sealed to a tubular housing 74. Input refrigerant line 12 is connected to an input port 76 by a connector nut 78. A similar output line 13 is connected to an output port 80 by a port connector 82. An exhaust feed line 64 is connected to the center of the housing cap 70 at port 84 by connector 86. A pick-up tube 88 extends vertically from the output port 80 vertically substantially the full length of tank 50 to end near end cap 72. A mounting screw 90 is provided at the bottom of end cap 72.

Figure 3:
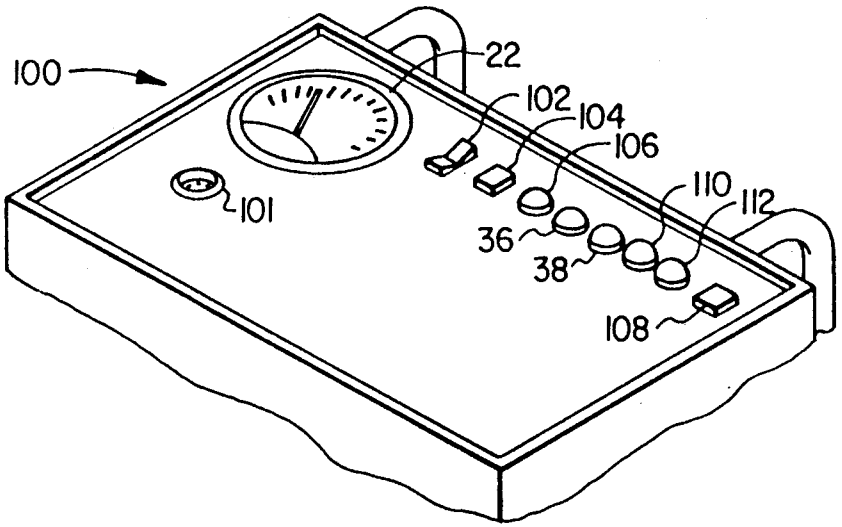
FIG. 3 is a plan view of the control panel of the embodiment of the invention shown in FIG. 1.
Figure 4:
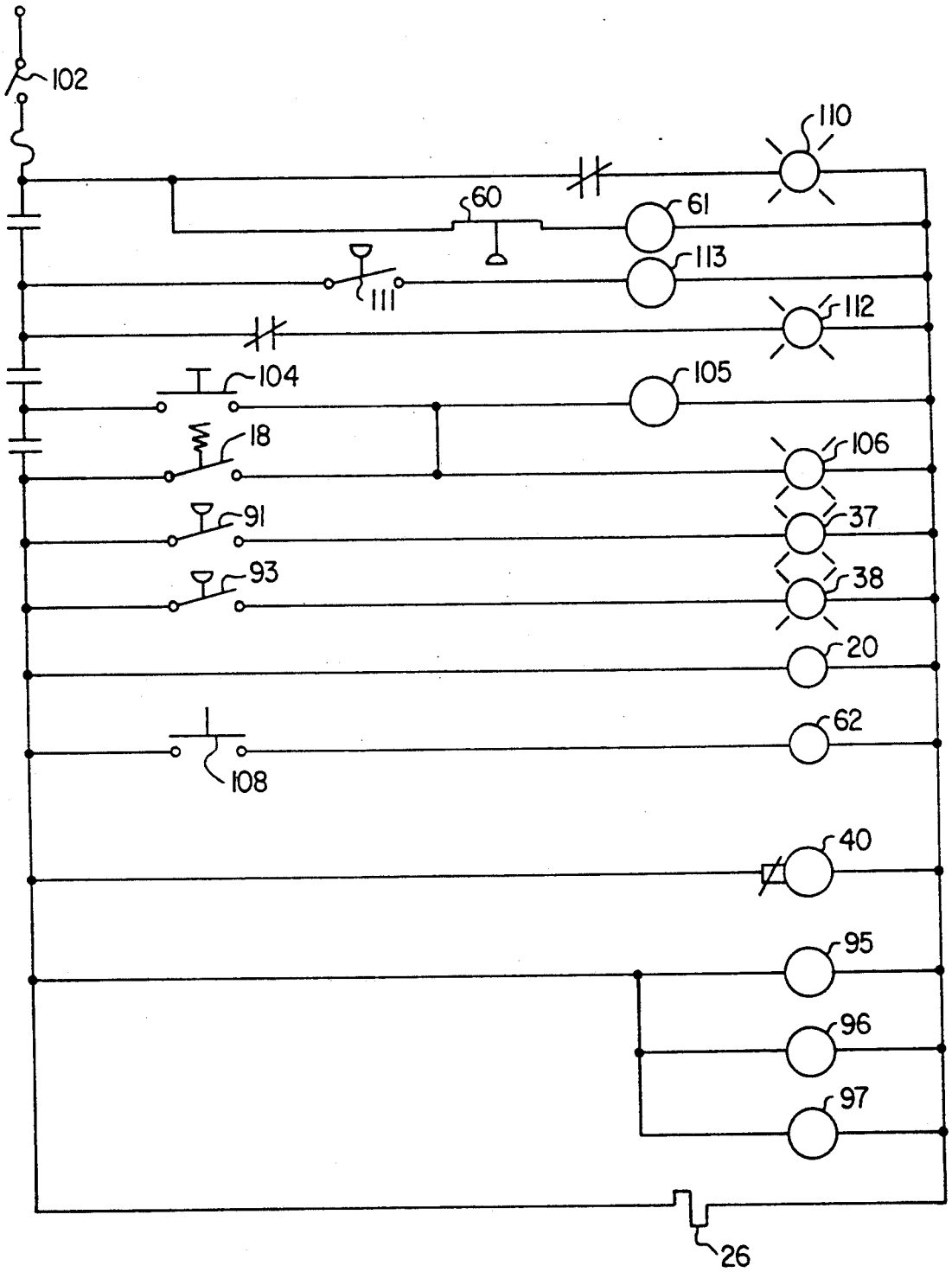
FIG. 4 is a circuit diagram for the electrical circuitry of the embodiment of the invention in FIG. 1.

Looking now at FIGS. 3 and 4, the control panel 100 and the related electrical circuitry 120 for the recovery and purification system of the present invention is shown. Typically, the control panel is mounted on the top of a portable cabinet containing all of the apparatus shown in FIG. 1. It is contemplated that this portable unit can be readily moved adjacent to an automobile to be connected directly to its air conditioning system for recovering and purifying the refrigerant therein.

On the lefthand side of control panel 100 is low pressure gauge 22 indicating the pressure of the refrigeration system being evacuated. A hook-up port 101 is provided the connect to the low pressure line of the refrigeration system to be evacuated. An on/off rocker switch 102 turns on power to the recovery and purification system. The cycle start switch 104 turns on the compressor to start up the system. A system operating light 106 confirms that the system is turned on. Filter lights 36 and 38 are provided to indicate when the filter pressure of filters 32 and 34 respectively have exceeded a threshold pressure level requiring the filters to be changed. A high pressure light 110 indicates whether the system has exceeded an acceptable pressure level requiring shutdown. A tank light 112 is shown which is activated by a tank switch 111 and relay 113 when the storage tank in which the liquid refrigerant is being stored is filled to a certain level. A positive pressure switch 108 is also provided to activate the auto-purge solenoid 62 and to direct pressure from collection tank 50 through positive-pressure line 64 to the oil separator unit 24.

In operation, the recovery and purification system of the present invention is connected to a refrigeration system such as the air conditioning system of an automobile. Connection is made from the high and low pressure ports of the automobile air conditioning system to intake port 101. Then rocker switch 102 on instrument panel 100 is pushed on and start switch 104 is momentarily depressed for about 2–3 seconds. This activates relay 105 and system operating light 106 will turn on indicating that compressor 40 has been started and is beginning to pump refrigerant from the vehicle.

The refrigerant will flow out of the vehicle's air conditioning system and through the micron filter 14 to the oil separator 24. This action will remove the majority of the oil and particles from the refrigerant. The refrigerant is then processed by filter/dryers 32 and 34 to remove substantially all of the moisture therefrom. The vaporized refrigerant then passes through compressor 40 to the compressor oil separator 42 where the compressor oil which has been picked up by the refrigerant is returned to compressor 40. The refrigerant moves on through coil 46 to the condenser 48 preferably having fan circuits 95, 96 and 97, where it is liquified and goes to tank 50 in which the non-condensible gases are separated. The liquified gas is then collected into tank 54 and the non-condensible gases are purged through solenoid 62 and line 64 back into the system at oil separator 24. A high pressure switch 60 is provided to actuate a relay 61 to release an undesirable high pressure buildup in tank 50.

The recovery unit 10 of the present invention will run until substantially all of the refrigerant has been recovered. When the refrigeration system pressure shows 17 Hg on low pressure gauge 22, vacuum switch 18 will shut off compressor 40, the system operating light 106 will go out and the unit will shut off completely. The positive pressure switch 108 on panel 100 is then depressed for about 3 seconds which activates purge solenoid 62 to provide positive pressure to oil separator 24. Hand tap 28 at the back of the machine is slowly opened to remove oil from the oil separator 26. Preferably the oil is removed into a measuring bottle 30 to be measured so that the proper oil charge may be reinstalled in the new vehicle refrigerant.

Typically, storage tank 54 holds about 28 pounds and each vehicle air conditioning system comprises about 3-¼ to 4 pounds of refrigerant. After processing about 6 automotive air conditioning systems, tank 54 will register about 80% full. At that time the liquid level float in the tank will activate the tank switch 111 and relay 113 to automatically shut off the recovery system 10. Tank light 112 comes on showing that the tank is full.

During operation, filters 32 and 34 may become contaminated to the point where they need to be changed. This is normally indicated by pressure in the filter reaching a intolerable level, preferably about 25 psi. At that point, either or both of filter switches 91, 93 will open and lights 36, 38 on the control panel 100 will turn on indicating that the filter which needs to be changed. At the same time, it is advisable to change the filter core of particulate filter 14.

In changing the filters, the inlet port is capped and rocker switch 102 and cycle start switch 104 are turned on. The unit is allowed to run until the system operating light 106 turns off, indicating that all refrigerant has been pumped out of the filter container. The valve core on the filter to be replaced is depressed, venting in the filter canister. The canister is then unscrewed and the old core is replaced. A similar process is used for the particulate filter. Thus, all filters in the system can be easily and quickly removed by using the quick change-out containers so that the system can continue to service additional automotive air conditioning systems.

Various modifications may be made to the inventive concepts shown herein, all of which may be apparent to those skilled in the art, without departing from the spirit and scope of the present invention.

The invention claimed is:

1. A one-pass closed system for recovering and purifying refrigerant from a refrigeration unit and purifying the refrigerant in a single pass through the system without contaminating the atmosphere, comprising:

(a) particulate filter means connected to the refrigeration unit for removing contaminants from the refrigerant;

(b) a first oil separator connected to the particulate filter means for removing oil from the refrigerant before compression;

(c) dryer/filter means connected to the first oil separator means for removing substantially all of the moisture from the refrigerant in a single pass;

(d) a refrigerant compressor connected to the filter means;

(e) a condenser connected to the refrigerant compressor for liquefying the refrigerant; and (f) collection means connected to the condenser means for collecting the liquified refrigerant and separating non-condensible gases from the liquid refrigerant, further including purge means for selectively introducing said separated non-condensible gases from the liquid refrigerant into the system before the compressor, in order to elevate the system pressure without releasing refrigerant into the atmosphere.

2. The system of claim 1 wherein said dryer means comprises multiple dryer units connected in series.

3. The system of claim 2 wherein said multiple dryer units each comprise an high moisture absorption filter within a multiple-piece quick-change container.

4. The system of claim 2 wherein each filter includes an indicator for sensing and displaying an indication that the filters need to be changed.

5. The system of claim 4 wherein said indicators each comprise a light which turns on when the pressure in the filter exceeds a predetermined level.

6. The system of claim 1 wherein said collection means comprises a tank having a tube running substantially the depth of the tank for collecting the liquid refrigerant from near the bottom of the tank, and said purge means is located near the top of the tank for removing the non-condensible gases.

7. The system of claim 6 wherein said closed loop is connected to the system at or before said oil separator and said oil separator includes an oil tap for removing the oil separated from the refrigerant charge of the refrigeration unit wherein vacuum produced at the oil separator may be relieved by said introduced non-condensible gases so that oil may be tapped from the oil separator for reuse with said charge as desired.

8. The system of claim 1 and further including a compressor oil separator connected to the compressor for removing oil added to the refrigerant by the compressor and an oil return line from the compressor oil separator to the compressor for inputing the separated oil back to the compressor.

9. A method of removing refrigerant from a refrigeration unit into a refrigeration recovery and purification system and purifying the refrigerant in a single pass through said system comprising:

(a) pumping the refrigerant from the refrigeration unit into the system with a compressor;

(b) removing the particulate matter from the refrigerant;

(c) separating the oil from the refrigerant with an oil separator;

(d) processing the refrigerant through multiple filter units to remove substantially all of the moisture therefrom in a single pass;

(e) liquifying the refrigerant using a condensor;

(f) separating the liquified refrigerant from residual non-condensible gases;

(g) purging the non-condensible gases wherein said purging step includes directing the non-condensible gases to the oil separator to assist in the removal of the oil from the oil separator; and (h) storing the liquified refrigerant.

10. A closed path refrigerant recovery and purification system for connection to a refrigeration unit in order to draw out and purify the refrigerant, from the unit without contaminating the atmosphere with the refrigerant, comprising;

(a) compression means for removing refrigerant from a refrigeration unit and passing it through an oil separation unit;

(b) oil separation means for removing oil from the refrigerant;

(c) filter means for removing moisture from the refrigerant from which the oil has been separated;

(d) condensor means for liquefying the refrigerant vapor after oil and moisture have been removed to produce purified liquid refrigerant;

(e) collection means for removing non-condensible gases from the purified liquid refrigerant wherein the collection means comprises a tank having a top and a bottom, the tank having liquid collection means therein for removing the purified liquid refrigerant, said liquid collection means comprising a tube extending substantially the entire length of the tank between the top and the bottom for collecting the liquid refrigerant near the bottom of the tank, purge means for selectively purging the non-condensible gases from the collection means, and gas collection means therein communicating with said purge means for removing the non-condensible gases from the liquid refrigerant wherein said gas collection means comprises an exhaust port in the top of the collection tank and said purge means includes a purge valve connected to the exhaust port for purging non-condensible gases, said purge means being connected to said oil separation means to direct the non-condensible gases thereto; and (f) storage means for storing the purified liquid refrigerant.

11. The system of claim 10 wherein said filter means comprises multiple filtering units connected in tandem.

12. The system of claim 11 wherein said multiple filter units each comprise a high moisture absorption filter within a quick-change canister.

13. The system of claim 11 and further including pressure indicator means on each of said filters for indicating when the pressure in the filters exceeds a predetermined level.

14. The system of claim 10 wherein said compression means further includes compression oil separator means for separating and returning to the compressor the oil added to the refrigerant by the compressor.

15. The system of claim 10 and further including switch means for connecting and disconnecting the refrigeration system to said recovery and purification system.

16. A method of recovering and purifying refrigerant in a refrigeration unit comprising:

(a) pumping the refrigerant from the refrigeration unit into a refrigeration and purification system;

(b) removing particulate matter from the refrigerant;

(c) separating oil from the refrigerant;

(d) removing the moisture from the refrigerant;

(e) condensing the refrigerant;

(f) removing the non-condensible gas from the liquified refrigerant including the steps of drawing out the liquified refrigerant and purging the non-condensible gases, said purging step includes applying the non-condensible gases to the recovery and purification system before the compressor to equalize the pressure in the refrigerant recovery and purification system; and (g) storing the liquified refrigerant.

17. The system of claim 16 wherein said filtering step comprises processing the refrigerant through multiple filters in tandem to remove substantially all of the moisture from the refrigerant.

18. The method of claim 17 wherein said pumping step includes drawing the vaporized refrigerant from the refrigeration system by use of a compressor.

19. The method of claim 18 and further comprising the step of removing oil from the refrigerant after it has gone through the compressor and returning the oil to the compressor for use by the compressor.

* * * * *

UNITED STATES PATENT AND TRADEMARK OFFICE

CERTIFICATE OF CORRECTION

PATENT NO. : 5,187,940

DATED : February 23, 1993

INVENTOR(S) : Paxton

It is certified that error appears in the above-identified patent and that said Letters Patent is hereby corrected as shown below:

In column 5, line 28, delete "1/4" and add --1/2--.

In column 5, line 48, after "venting", add --the vacuum--.

Signed and Sealed this

Second Day of August, 1994

Attest:

Bruce Lehman

BRUCE LEHMAN

Attesting Officer

Commissioner of Patents and Trademarks